US008029119B2

(12) United States Patent
Sassano et al.

(10) Patent No.: US 8,029,119 B2
(45) Date of Patent: Oct. 4, 2011

(54) INK JET PRINT HEAD WHICH PREVENTS BUBBLES FROM COLLECTING

(75) Inventors: Duccio Spartaco Sassano, Arnad (IT); Alessandro Scardovi, Ivrea (IT); Giancarlo Martina, Arnad (IT)

(73) Assignee: Telecom Italia S.p.A., Milan (IT)

( * ) Notice: Subject to any disclaimer, the term of this patent is extended or adjusted under 35 U.S.C. 154(b) by 439 days.

(21) Appl. No.: 11/887,590

(22) PCT Filed: Mar. 31, 2005

(86) PCT No.: PCT/IB2005/000840

§ 371 (c)(1),
(2), (4) Date: Mar. 19, 2009

(87) PCT Pub. No.: WO2006/103485

PCT Pub. Date: Oct. 5, 2006

(65) Prior Publication Data

US 2009/0213198 A1 Aug. 27, 2009

(51) Int. Cl.
*B41J 2/19* (2006.01)
*B41J 2/05* (2006.01)

(52) U.S. Cl. ..... 347/92; 347/65

(58) Field of Classification Search ..... 347/65, 347/67, 92, 93

See application file for complete search history.

(56) References Cited

U.S. PATENT DOCUMENTS

| | | | | |
|---|---|---|---|---|
| 6,132,034 | A | 10/2000 | Miller | |
| 6,158,843 | A * | 12/2000 | Murthy et al. | 347/47 |
| 6,231,168 | B1 | 5/2001 | Maze et al. | |
| 6,309,054 | B1 * | 10/2001 | Kawamura et al. | 347/65 |
| 6,331,055 | B1 | 12/2001 | Miller et al. | |
| 6,457,821 | B1 * | 10/2002 | Liu et al. | 347/93 |
| 6,746,106 | B1 | 6/2004 | Hager | |
| 7,370,944 | B2 * | 5/2008 | Cabal et al. | 347/65 |

FOREIGN PATENT DOCUMENTS

| | | |
|---|---|---|
| EP | 1 213 147 A1 | 6/2002 |
| EP | 1 098 771 B1 | 4/2003 |
| WO | WO 00/00354 | 1/2000 |

OTHER PUBLICATIONS

International Search Report dated Nov. 16, 2005 issued in PCT/IB2005/000840.

* cited by examiner

*Primary Examiner* — Anh T. N. Vo

(74) *Attorney, Agent, or Firm* — Venable LLP; Roberg Kinberg; Steven J. Schwarz

(57) ABSTRACT

Ink jet print head comprising a substrate with an upper surface and a lower surface; a plurality of actuators with ejection chambers and ink supply passages, an ink distribution slot formed in the substrate between the lower surface and the upper surface; a manifold formed in the substrate of the upper surface around the slot for the feed to the actuators; and a plurality of bubble prevention elements formed in the feed manifold. The plurality of bubble prevention elements is provided only for a marginal set of actuators remote from the distribution slot.

8 Claims, 11 Drawing Sheets

INK JET PRINT HEAD WHICH PREVENTS BUBBLES FROM COLLECTING

TECHNICAL FIELD

The invention relates to ink jet print heads, and more particularly to ink jet print heads of the thermal type and the method for their manufacture.

BRIEF DESCRIPTION OF THE PRIOR ART

For ink jet printing, use is made of print elements, each of which typically comprises an ink tank and a print head connected to it.

In its turn, the print head, particularly in the case of what is known as a thermal head, comprises a plurality of actuators, positioned in one or more rows, each provided with an ejection chamber and a corresponding emission nozzle. The construction and mode of operation of ink jet print heads, particularly those of the thermal "top shooter" type, in other words those having actuators which emit ink drops in a direction perpendicular to an ejection chamber, are known in the art and consequently will not be described here in detail.

In serial printers, the head is moved transversely with respect to the surface to be printed, and the length of a print scan in one pass is approximately equal to the length of the rows of nozzles.

The actuators are made in plates, each having a semiconductor substrate, which are typically formed from a silicon wafer.

On one face of the substrate there are deposited various layers, forming the ejecting resistors and active electronic components, and a structural layer, made for example from a photopolymer. By means of photolithographic methods, ejection chambers and ink feed channels are formed in a photopolymer layer; finally, a plate, called the "nozzle plate", is fixed on to the photopolymer, or a corresponding structure is formed as an integral part of the photopolymer structure, having the ejection nozzles next to the chambers.

In a typical arrangement, the ink is fed through a slot which is common to a plurality of ejection chambers and communicates with an ink tank, while the actuators are positioned on one side, or preferably on both sides, of the slot. The substrate plate is rectangular and the distribution slot is oblong and has an overall length which is less than the length of the plate and is sufficient to feed all the chambers in a uniform way.

At the present time, the market requires particularly large ink jet print heads which can provide a high operating frequency and high reliability. Especially for photographic printers, large numbers of nozzles and high print definition are also required, while the actuators and corresponding hydraulic circuits must be small.

For reasons of cost, the distribution slots are commonly formed by machining processes, such as sandblasting, which are inherently relatively rough. The actuators cannot be formed too close to the slots, because of the large tolerances on the sizes and profiles of the walls of the slots.

On the other hand, an increase in the distance between the actuators and the slot causes an increase in the width of the plate, thus reducing the number of plates that can be formed from the silicon wafer, which has standard dimensions as a commercial product.

European Patent EP 1098771 describes a print head which has an ink feed manifold which is located around the distribution slot and is etched into the upper face of the plate, with a substantially flat bottom, and is connected to the various actuators. Most of the actuators are adjacent to the slot, while other actuators of each row, which form marginal groups, extend beyond the ends of the slot.

Instead of a single slot, a plurality of partial slots are also provided, these slots being aligned with each other, joined by links and terminating in a single manifold.

The print head also has independent manifolds and corresponding slots for the use of inks of different colors.

U.S. Pat. No. 6,231,168 describes an ink jet print head having an ink distribution slot and a collecting chamber around the slot, formed by a barrier layer which delimits an ejection chamber for each resistor. A nozzle plate positioned above is provided with passive orifices, each next to the angles formed by the lateral walls and the end walls of the manifold, for releasing trapped air. Each of the two end walls of the collecting chamber forms a projection with a wedge-shaped cross section extending towards the interior. The projections occupy the parts of the manifold in which the ink is substantially stationary, in order to prevent the formation of large bubbles.

U.S. Pat. No. 6,746,106 describes an ink jet print head with partial feed slots and rectangular manifolds within which the partial feed slots are formed, these slots possibly forming collecting areas for the fluid to be fed to the drop generators. Flat surfaces such as the flat bases of these manifolds tend to collect and grow air bubbles which may impede or block the flow of fluid from the feed slots to the drop generators. To alleviate the problem of air bubbles collecting on the flat base surface of the manifold, a series of barriers is formed in the lateral walls of each manifold in a position adjacent to the drop generators. The barriers are tapered to form alternating diverging channels leading away from the ejection chambers, in saw-tooth or comb form.

The Applicant has observed that the presence of the projections along the two sides of the slot gives rise to an increase in the overall dimensions of the plate. Furthermore, the presence of these projections in front of the passages leading the ink towards the ejection chambers disturbs the flow of the ink, thus adversely affecting the response speed of the head.

The Applicant has observed that the prior art solutions have elements for preventing bubble formation which affect the path of the fluid towards the ejection chambers in an irregular way, thus changing the hydraulic impedance which determines the capacity of the said chambers to be fed with new fluid after each emission, and consequently affecting the emission frequency of the head.

BRIEF DESCRIPTION OF THE INVENTION

According to the present invention, the Applicant has observed that bubble formation is substantially limited when the distance between the ink supply slot and the ejection chambers is relatively short and the ink path is direct, while the probability of bubble formation is greater when the distance between the ink supply slot and the ejection chamber is longer.

In particular, the Applicant has observed that, where the distance between the ejection chambers and the feed slot is relatively short, particularly in the case of ejection chambers facing the edge of the slot itself, any small bubbles which are formed can be rapidly collected in the wide passage formed by the feed slot and can travel away from the emission area without causing problems, and that it is therefore useful to reduce the obstacles to the flow of ink in these areas.

However, in areas in which the ejection chambers are relatively distant from the feed slot, particularly in the presence of a collector manifold interposed between the chamber and the slot, the Applicant has observed that it is possible for small bubbles to collect and to coalesce over time.

According to the invention, it has therefore been found that, in the case of ejection chambers located next to the intermediate area of the feed slot, the presence of preventive elements makes no significant contribution to the reduction of the bubble phenomenon, but changes the hydraulic behavior.

In the case of ejection chambers located at the ends of the feed slots, preventive elements can efficiently prevent the formation and growth of bubbles without changing the hydraulic characteristics of the head, these elements being preferably configured in a suitable way.

According to the present invention, therefore, it has been found that the formation or growth of bubbles in an ink jet print head can be substantially limited without changing the hydraulic characteristics of the feed circuit of the emission chambers, by placing projecting elements next to the peripheral emission chambers of each fluid feed slot and substantially in alignment with the lateral edges of these emission chambers.

Thus, in the case of these marginal ejection chambers, the presence of obstacles to the ink flow was substantially limited, thereby avoiding the creation of areas of deceleration or stagnation of the said ink in which bubbles could collect and grow, while care was also taken to avoid leaving relatively large areas where possible small bubbles could grow.

In a first aspect, the present invention relates to an ink jet print head comprising:

- a substrate;
- a feed slot which passes through the thickness of the substrate;
- a manifold formed in the surface of the substrate around the said slot, having at least one substantially rectilinear side;
- a plurality of actuators positioned in a row substantially parallel to the said rectilinear side, the said row of actuators comprising a first set of actuators adjacent to the slot and a second set of actuators not adjacent to the slot;

characterized in that a plurality of bubble prevention elements are present in the said manifold, next to the said second set of actuators only.

For the purposes of the present invention, the phrase "actuators adjacent to the slot" means that the actuators are located substantially facing the said slot, in such a position that the ink path from the slot towards the actuators is substantially rectilinear in plan view and perpendicular to the side of the manifold. The phrase "actuators not adjacent to the slot" means that actuators are located facing the end surface of the manifold, in such a position that the ink path from the slot towards the said actuators is, in plan view, substantially oblique with respect to the rectilinear side of the manifold, or non-rectilinear.

Preferably, the said prevention elements comprise a pair of prevention elements positioned between one of the said actuators and the slot, on opposite sides of the said actuator.

Preferably, the actuators have an interval "P", and the space between two prevention elements is a value "D" which is greater than 0.5 P.

In a preferred embodiment, the said prevention elements comprise peninsula-like projections from the walls of the aforesaid manifold, preferably having a substantially constant width.

In a preferred embodiment, each of the said actuators comprises an ejection chamber, delimited by corresponding boundary peninsulas of the adjacent chambers, and the said prevention elements have their longitudinal axes substantially aligned with the said boundary peninsulas.

In a preferred form of a preferred embodiment, the said prevention elements have a length which increases with an increase in the distance of the actuator from the distribution slot along the said manifold.

In an alternative embodiment, the said prevention elements include islands projecting from the end of the manifold and positioned next to the said second set of actuators.

In a specific embodiment, the said substrate includes at least one pair of slots separated by at least one link and surrounded by a single ink feed manifold and at least one of the said prevention elements is positioned next to the said link.

Further characteristics of the invention are described in detail in the following description, provided solely as an illustrative example without restrictive intent, and with reference to the attached drawings.

DESCRIPTION OF A PREFERRED EMBODIMENT

Figure 1:
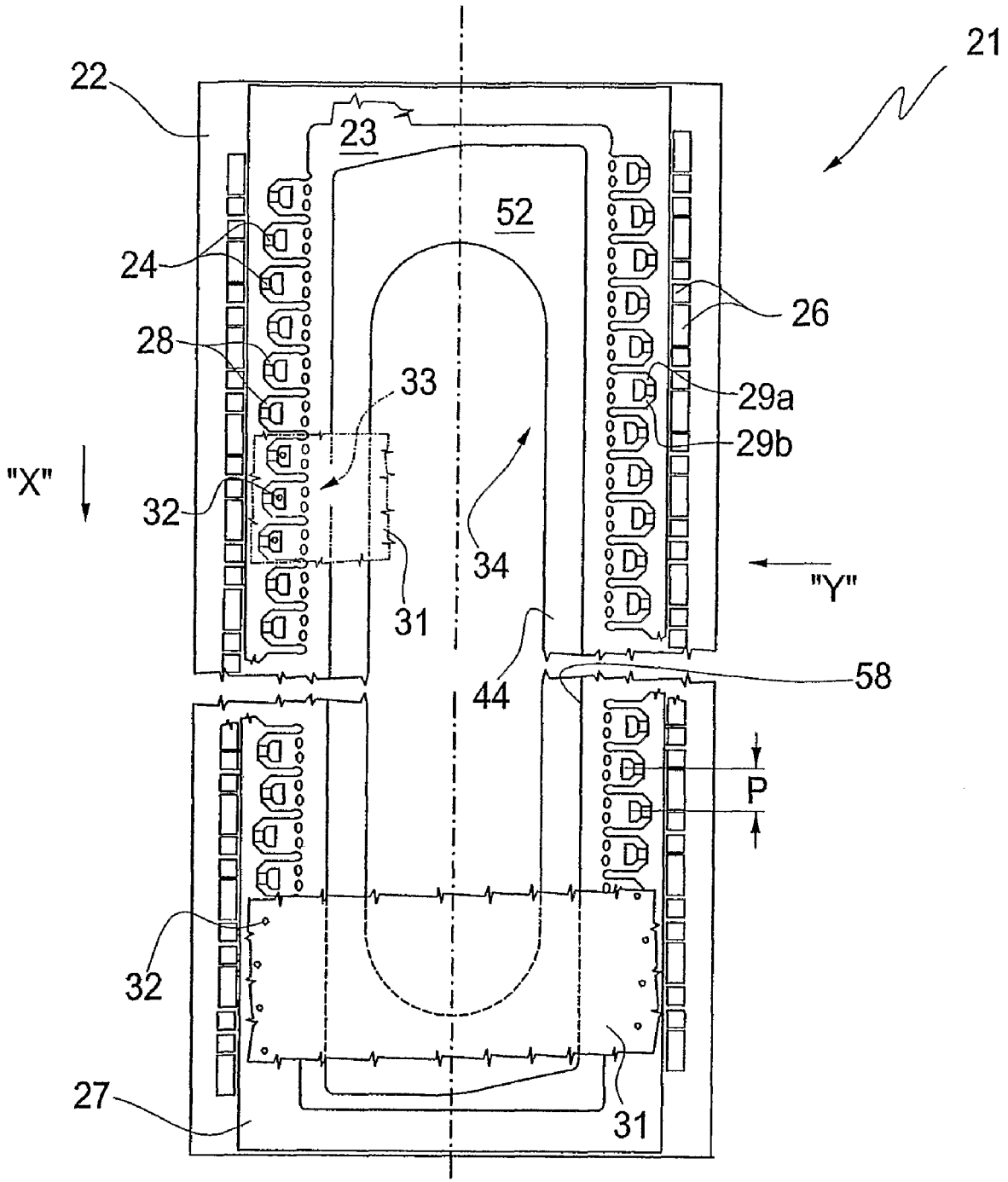
FIG. 1 shows schematically a partial plan view of an ink jet print head.

FIG. 1 shows schematically part of a thermal ink jet print head 21 with "top shooter" actuators, comprising a substrate plate 22 of rectangular shape, elongated in the longitudinal direction and having an upper surface 23.

The substrate plate 22 is usually made from silicon, although other materials can be used. Layers of thin film which form a plurality of emission resistors 24 and conductors 26, and a structural layer 27, are placed on the surface 23.

The layer 27 forms the walls of ejection chamber 28 and of supply passages 29*a* and 29*b*. It is made from photopolymer, for example, and has a thickness "h1" of 15-30 μm.

For the purposes of the present description, the term "photopolymer" denotes a material whose polymerization is activated or controlled by light radiation, for example by UV radiation.

An orifice plate 31, made for example from metal or plastics material, in which ejection orifices 32 are formed to correspond to the chambers 28, is bonded in a sealed way on top of the structural layer 27.

In an alternative embodiment (not shown), the orifice plate can be produced by deposition of one or more structural layers, made from photopolymer for example, to form a structure integral with the layer 27.

The emission resistors 24, the ejection chambers 28 and the supply channels 29*a* and 29*b* make up the actuators of the head, indicated by 33. The actuators 33 are conveniently distributed in two rows, with an interval "P" in the longitudinal direction "X" of the head, with each actuator of one row being displaced by half of the interval with respect to the corresponding actuator of the other row.

For the ink feed, the plate 22 has an ink distribution slot 34 lying between the lower surface and the upper surface 23. Typically, the slot 34 is extended in the longitudinal direction "X" and has an axis of symmetry between the two rows of actuators 33.

Figure 3:
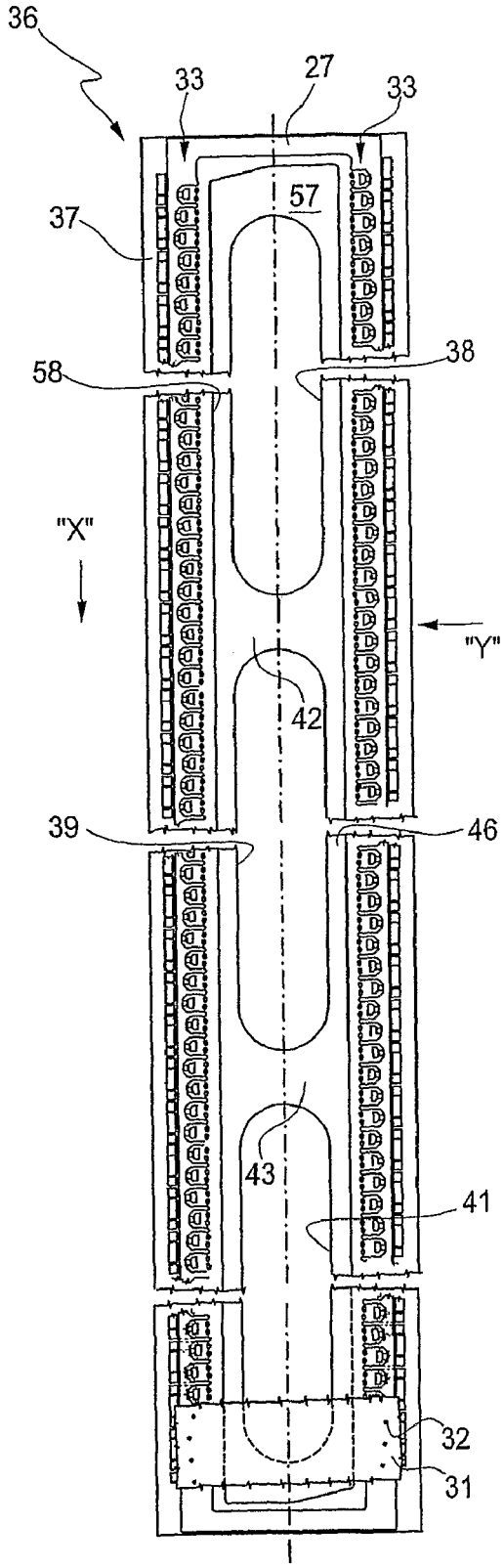
FIG. 3 is a partial plan view of a variant of the print head of FIG. 1.

FIG. 3 shows an ink jet print head 36 which is monochrome, black for example, and has a large number of orifices.

In the print head 21, 36, the upper surface 23 of the substrate plate 22, 37 has a depression around the slotted area or areas to form a feed manifold 44, 46, connected hydraulically to the ejection chambers 28 and the supply channels 29*a* and 29*b*.

The head 36 uses a substrate plate 37, also rectangular, extending in the direction "X" and having three partial distribution slots 38, 39, 41. Thus, instead of having a single continuous slotted area as in FIG. 1, the head 36 has a plurality of areas with partial distribution slots, having links of substrate 42 and 43 between the slots so as to reduce the weakening of the plate 37.

Figure 4:
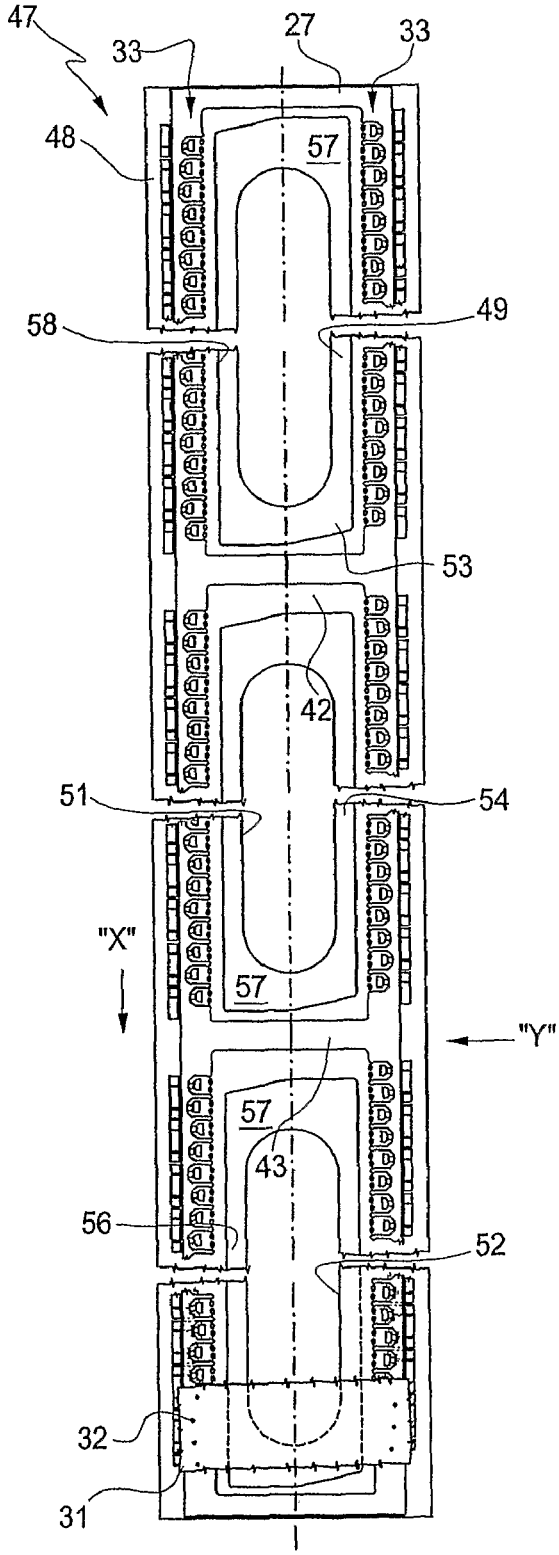
FIG. 4 is a partial plan view of another variant of the print head of FIG. 1.

FIG. 4 shows a head 47 with three separate sets of actuators, which can conveniently be used as a color head, with a substrate plate 48 dimensionally similar to the plate 37 of FIG. 3, but having three slots 49, 51 and 52 which distribute inks of different colors, and having each slot associated with a corresponding feed manifold 53, 54 and 56.

Other color heads, not shown in the figures, can have structures with distribution slots adjacent and parallel, and ink feed manifolds similar to that of the head 21 of FIG. 1.

The feed manifold or manifolds of the heads 21, 36, 47 (FIGS. 1, 2, 2*a*, 3 and 4) are recessed to a depth "h2" of 10-100 μm, typically 20 μm, and form accumulation areas for the ink to be fed to the ejection chambers. The manifolds have substantially flat base surfaces 57 and lateral walls 58 formed in the thickness of the plate 22, 37, 48.

The lateral walls 58 of the manifold 44, 46 or of the manifolds 53, 54, 56 are at a relatively short distance "b" (FIG. 5) from the corresponding slots 34; 38, 39, 41; 49, 51, 52. To meet the functional requirements of the head and to allow for the corresponding production process, this value is typically set between 20 and 50 μm.

This is because, for plates of equal strength, higher values impede the regular flow of the ink and reduce the operating frequency, while lower values are not usually convenient, particularly where the slot or slots have been machined, after the deposition of the layers forming the actuators and the corresponding supply channels, by a method such as sandblasting, which is relatively imprecise in delimiting the walls of the slot, leading to possible damage to these layers if the walls are too close to the channels.

Figure 2:
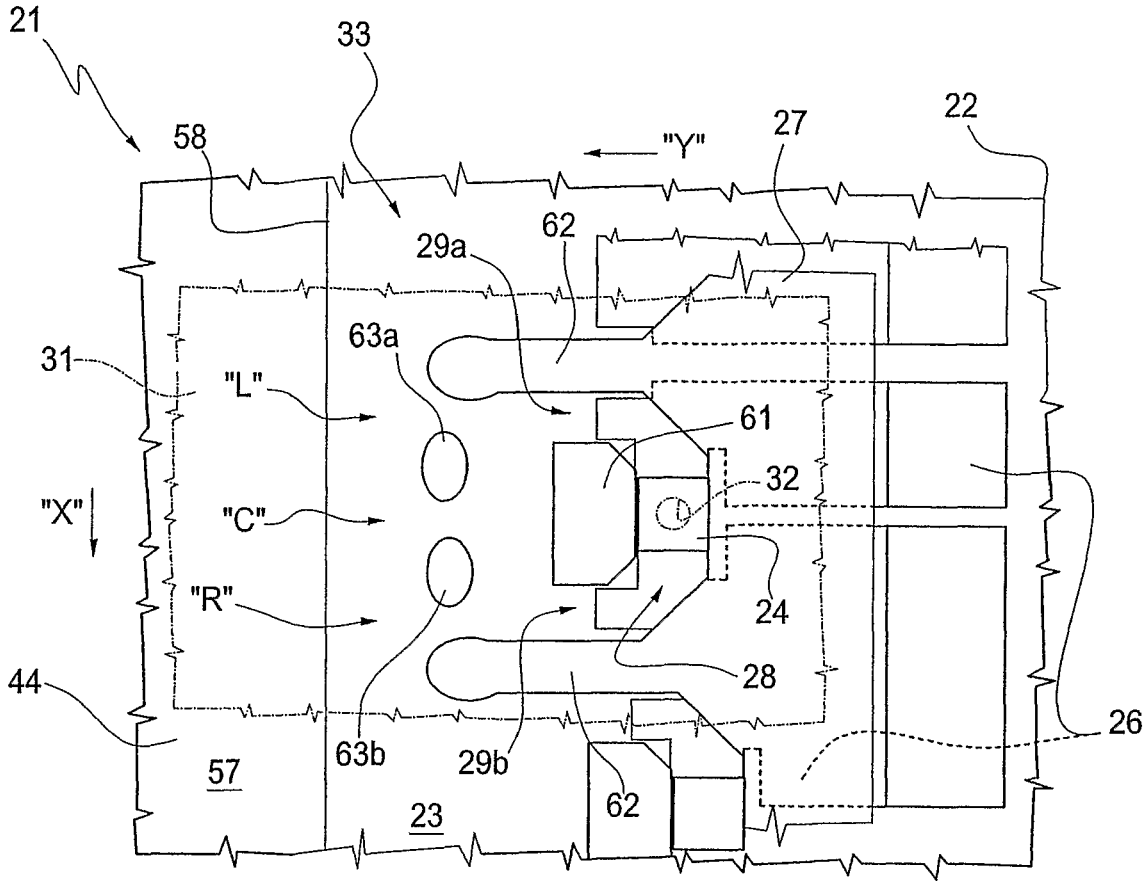
FIG. 2 is a detail on an enlarged scale of the head of FIG. 1.
Figure 2A:
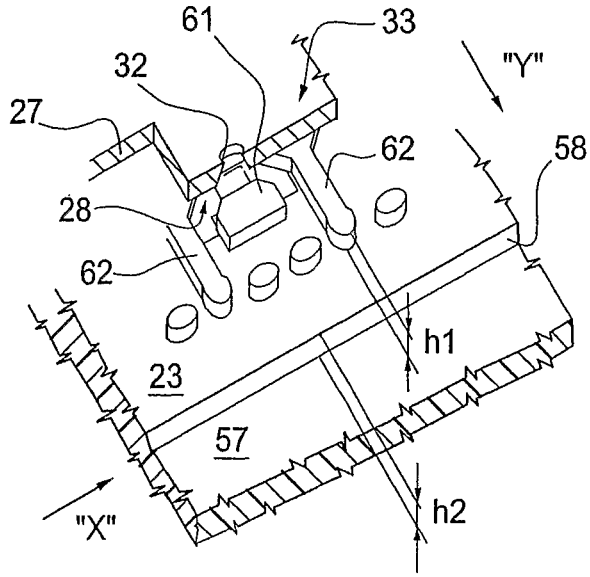
FIG. 2*a* is an axonometric view of the detail of FIG. 2.

As shown in FIG. 2, each chamber 28 is delimited by a rear wall and two lateral walls, formed at an angle in the thickness of the layer 27, and, in the front, by the rear wall of a barrier island 61 which is also formed in the layer 27. The lateral walls of two boundary peninsulas 62 and the corresponding lateral walls of the island 61 form the two passages 29*a* and 29*b*.

Conveniently, two filter islands 63*a* and 63*b* are also provided between the barrier island 61 and the slot, to protect the chamber 28 from the ingress of impurities.

The access path of the ink towards each chamber 28 comprises two lateral portions "L" and "R" through the passages formed, respectively, by the filter island 63*a*, the peninsula 62 and the angled lateral walls of the chamber, and by the filter island 63*b*, the peninsula 62 and the angled lateral walls of the chamber, and a central portion "C" through the passage formed between the filter islands 63*a* and 63*b*, which flows into the aforementioned passages.

The filter islands 63*a* and 63*b* are, conveniently, substantially aligned with the ends of the peninsula 62; it has been observed that this configuration leads to a reduction of phenomena of "cross-talk" between adjacent ejection chambers, in other words reciprocal hydraulic effects between the ejection chambers.

For most of the actuators 33, located in intermediate positions in the longitudinal direction with respect to the manifold 57, in other words substantially facing each other along the lateral edge of the distribution slot 67, the corresponding ejection chambers 28 are close to the distribution slot; typically, the ends of the boundary peninsulas 62 and the filter islands 63*a* and 63*b* are approximately 20 μm from the lateral walls 58 of the manifold 57.

For these actuators, substantially facing each other along the lateral edge of the distribution slot 67, the supply passages 29*a* and 29*b* face the distribution slot substantially directly and the portion of manifold between the passages and the slot is relatively small. In the marginal actuators, in other words those located near the ends of the array of actuators hydraulically connected to a slot, the passages face an area of the corresponding feed manifold which extends for a certain distance beyond the end of the slot, and the portion between the walls 58 of the manifold and the edge of the slot becomes greater as the chambers become more marginal.

In a head of the type described above, it has been observed that the flat surfaces of the bases of the manifolds tend to retain and cause the growth over time of air bubbles which may form in the body of the ink and which flow until they collect in the said manifolds.

The air bubbles can impede or interrupt the flow of ink from the distribution slots to one or more of the ejection chambers.

Figure 5:
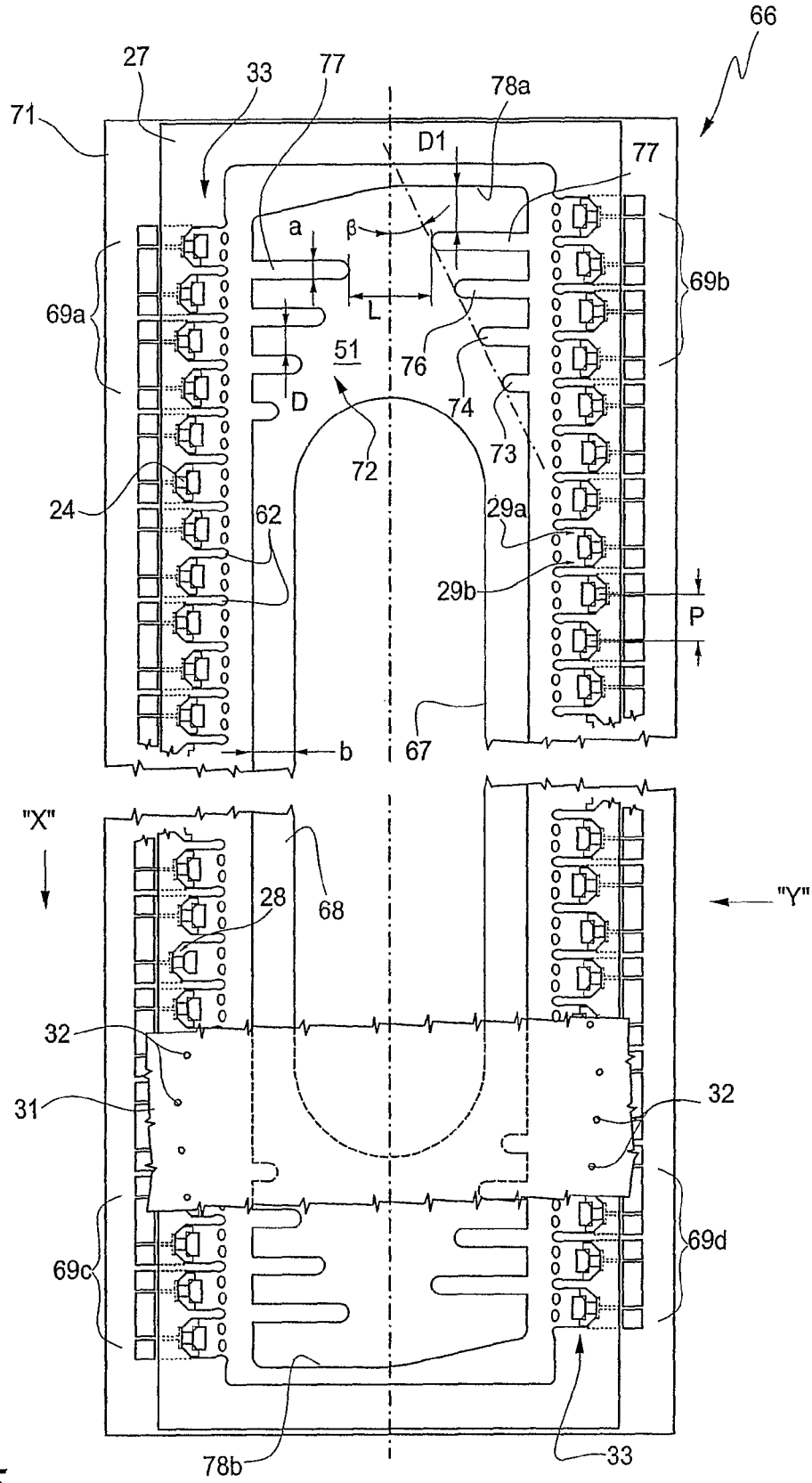
FIG. 5 shows schematically a partial plan view of a variant of an ink jet print head according to the invention.
Figure 6:
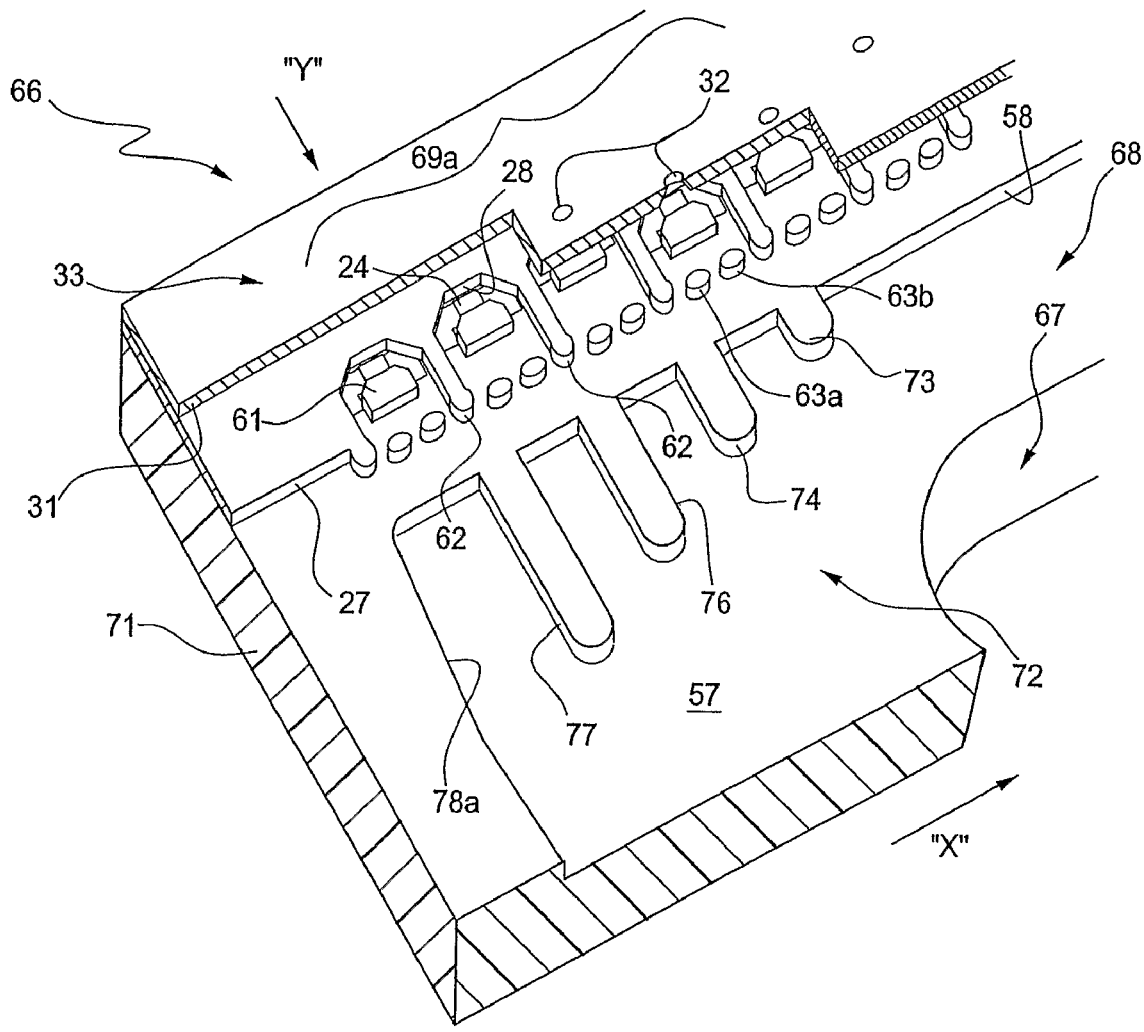
FIG. 6 is a sectional axonometric view of part of the print head of FIG. 5.
Figure 7:
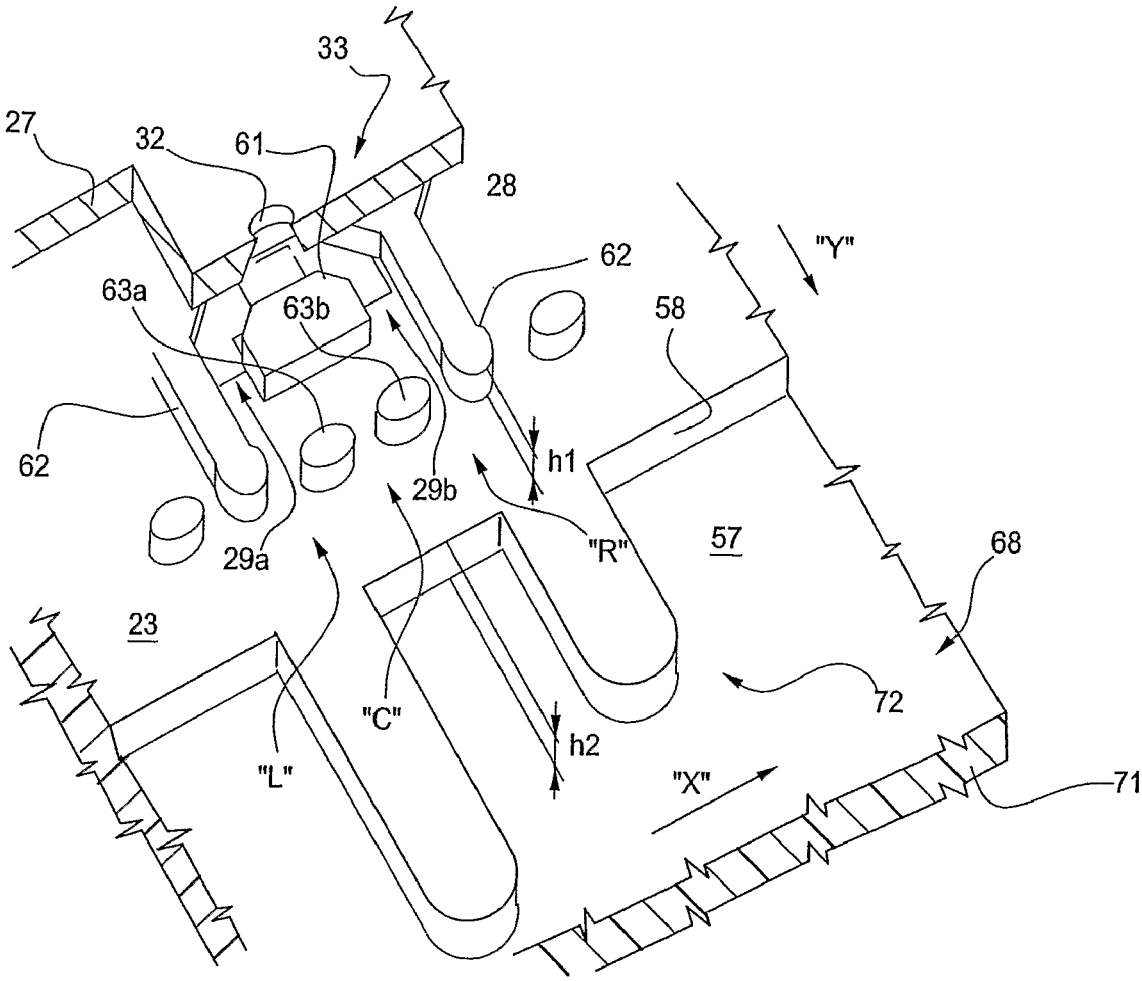
FIG. 7 shows details, on an enlarged scale, of the part shown in FIG. 6.

FIGS. 5-7 show an ink jet head 66, structurally similar to the head 21 of FIG. 1, in which functionally identical parts have been given the same numbering. The head 66 comprises, in particular, a distribution slot 67 extending in the longitudinal direction "X", a feed manifold 68, actuators 33 and a set of bubble prevention elements 72.

According to the invention, the bubble prevention elements 72 are associated with the sets of actuators 33 of each row which are marginal with respect to the distribution slot 67, indicated by 69*a*-69*d*.

Specifically, the head 66 comprises a substrate plate 71 made from silicon, elongated in the longitudinal direction "X", similar to the plate 22. The actuators 33 are distributed in two rows with intervals "P" at the sides of the slot 67, and each actuator includes an emission resistor 24, an ejection chamber 28 and supply channels 29*a* and 29*b*.

In a preferred embodiment, the bubble prevention elements include a plurality of projections 73; 74; 76; 77 formed in the lateral walls 58 of the manifold 68, beyond the ends of the slot 67. Conveniently, the prevention projections are relatively thin, so as to leave an access area of width "D" which is greater than the width "a" of the occupied area.

The projections 73; 74; 76; 77 are substantially in the form of piers which are substantially rectangular in plan view. Preferably, they are positioned in line with the boundary peninsulas 62 of the actuators 33.

Figure 10:
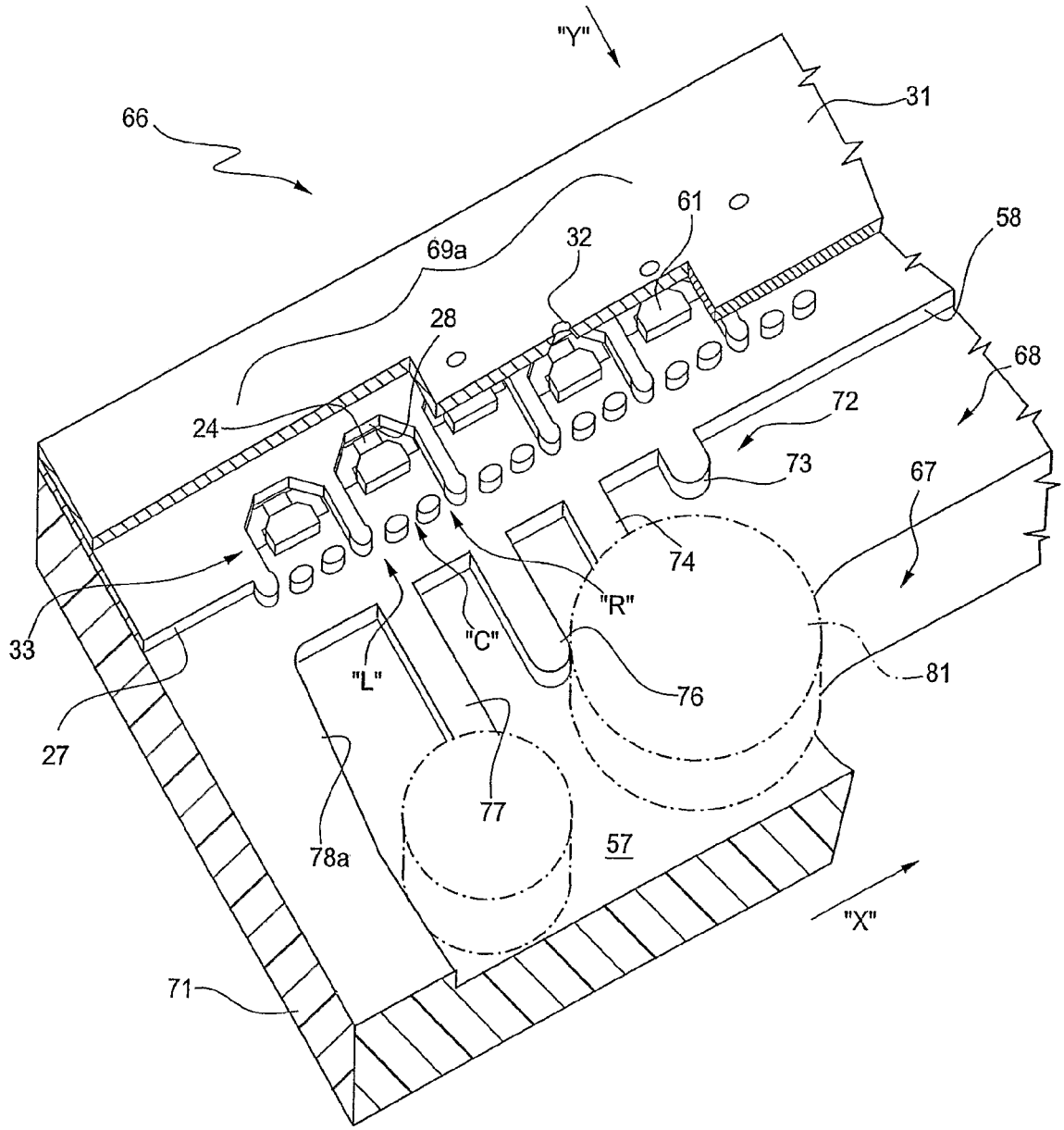
FIG. 10 shows the head part of FIG. 6 in an operating configuration.

FIG. 10 shows that, in this configuration, the flow of ink through the sections "C", "L" and "R" of the actuators 33 is not substantially affected by the presence of the piers 73; 74; 76; 77, since the said passage sections "C", "L" and "R" continue, in each case, to face the edge of the manifold 68, whose distance from them remains unchanged.

However, the piers 73; 74; 76; 77 effectively ensure that any bubbles 81 which may form in the terminal areas of the manifolds are kept away from the ejection chambers.

Moreover, the piers cause the larger bubbles, formed progressively during the operation of the head, to flow through the slot 67 into the ink tank.

In a head having ejection chambers located in two rows on opposite sides of the feed slot, the manifold 68 extends beyond the ends of the slot 67 through a distance corresponding to the specified number of marginal actuators (and to the corresponding interval). For example, if there are four marginal actuators 69*a*, 69*b*, 69*c*, 69*d* for each row (on each side of the slot), the manifold extends by 85-340 μm at each end, according to the interval between the chambers, and has a width of 250-400 μm. In this embodiment, the slot preferably has a width of 150-360 μm; the length of the slot depends on the specified number of ejection chambers and the corresponding interval (for example 2300-3800 μm).

The width "a" of the prevention piers 73; 74; 76; 77 depends on the characteristics of the head, and in particular on the interval "P" between the orifices and the corresponding emission chambers; for example, for heads with an interval "P" of 1/300" (84.5 μm), the width "a" of each pier is preferably 10-40 μm and the distance "D" is preferably greater than 0.5 P.

In each marginal actuation set 69*a*, 69*b*, 69*c*, 69*d*, the distance "D1" (FIG. 5) separating the final prevention pier 77 from the terminal wall 78*a*, 78*b* adjacent to it is preferably, in turn, substantially equal to the interval "P".

In the example described, the pier-like prevention projections 73; 74; 76; 77 have a substantially constant width and have their axes parallel to the direction "Y".

Conveniently, the length of the prevention projections or piers 73; 74; 76; 77 increases along the manifold as a function of the distance of the corresponding actuator from the ink distribution slot. By way of example, the piers 73; 74; 76; 77 have a length ranging from 30 μm to 150 μm, with their ends substantially tangential to a geometric plane which is inclined at an angle β of 30-60° to the longitudinal direction of the slot.

It is useful for the distance "L" between the last pier 77 of a row and the last row 77 of the other row to be greater than the distance "D1" between the last pier 77 and the terminal wall 78*a*, 78*b* of the manifold 68.

The ink flow along the path lying between the boundary peninsulas 62 of an actuator 33 and the manifold 68 with the corresponding piers 72 (FIG. 7) includes a portion of thickness h1 above the surface 23 of the plate, and a portion of thickness h1+h2, which is greater than h1, above the manifold.

The effect of the bubble prevention elements on the hydraulic behavior of the ink in the actuators of the head can be analyzed by means of the known relationships of electrical circuits, on the basis of analogies between electricity and hydraulics, using the following equivalences:

V=voltage in volts is equivalent to: pressure in $N/m^2$;

G=current in A is equivalent to: flow in $m^3/s$;

R=resistance in ohm is equivalent to: hydraulic resistance in $N\ s/m^5$;

L=inductance in henrys is equivalent to: hydraulic inertance in $kg/m^4$.

The hydraulic inertance is the ratio between the mass of the liquid column filling the passage and the square of the cross section of the said passage.

Figure 14:
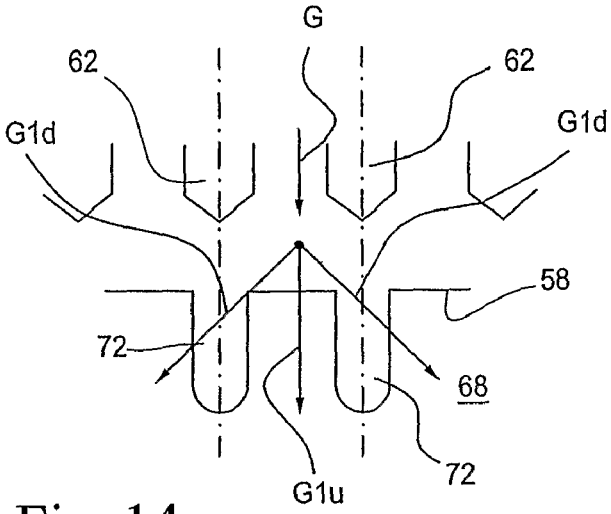
FIG. 14 is a hydraulic diagram of the head according to the invention.
Figure 15:
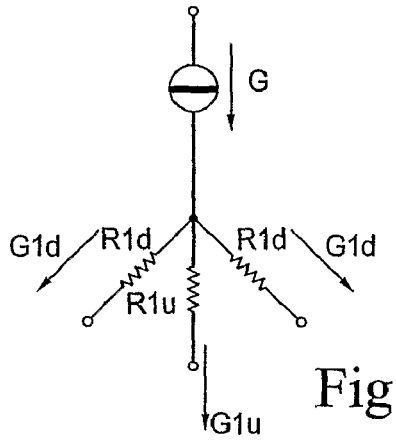
FIG. 15 is an electrical circuit simulating the diagram of FIG. 14.

The bubble prevention elements, made in the form of thin piers 72 aligned with the boundary peninsulas 62 and shown schematically in FIG. 14, optimize the hydraulic behavior of the actuators with respect to the ink path between the peninsulas 62 and the manifold 68, as is shown by the equivalent electrical circuit of FIG. 15.

The flow G has a direction towards the manifold 68 as shown in FIGS. 14, 15, 16, 17 during the expansion of the bubble generated by the ejection resistor; during the filling of the ejection chambers, which takes place after the collapse of this bubble, the direction of the flow G is the opposite of that shown in the figures. The following discussion relates to both cases, and the flow, in particular, is to be interpreted as an absolute value.

It comprises a generator of the flow "G" connected to the manifold through a branch having resistance "R1*u*", through which the flow "G1*u*" passes, and two lateral branches having resistance "R1*d*", through each of which the flow "G1*d*" passes.

The resistance "R1*u*" is relatively low, since it corresponds to the shorter and deeper portion h1+h2, located in the void between the two piers 72. On the other hand, the resistance "R1*d*" is greater, since it corresponds to a longer and shallower portion h1.

This maximizes the flow "G1*u*", which represents the useful flow of the ink fed from the tank to the ejection chamber during the filling of the said ejection chamber, while it minimizes the flow "G1*d*", responsible for an undesired phenomenon of "cross-talk" with the adjacent actuators.

Figure 16:
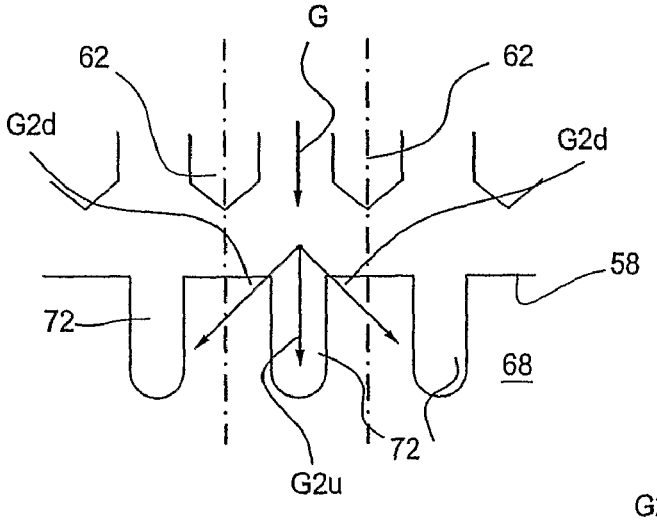
FIG. 16 is a variant of the diagram of FIG. 14.
Figure 17:
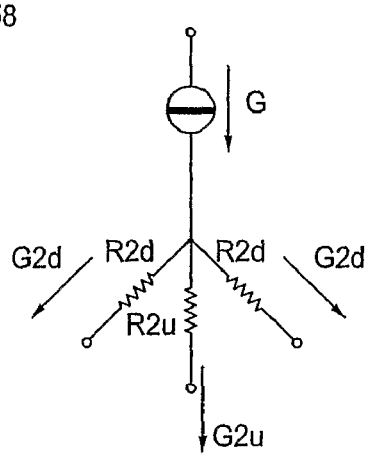
FIG. 17 is an electrical circuit simulating the diagram of FIG. 16.

For the purposes of comparison, FIG. 16 shows a diagram in which the piers 72 are out of alignment with the peninsulas 62. In the equivalent electrical circuit of FIG. 17, the generator of the flow "G" is connected to the manifold through a branch having resistance "R2*u*", which is greater than "R1*u*". This is because "R2*u*" relates to a portion in which the depth is smaller, being equal only to h1 because of the presence of the pier 72. The flow "G2*u*" passes along this branch.

The generator "G" is also connected to the manifold through two lateral portions having a resistance "R2*d*", which is smaller than "R1*d*" because it mainly relates to portions of the manifold having the greater depth h1+h2. The flow "G2*d*" passes along each of these branches.

This arrangement causes the central actuator to be fed preferentially by the two lateral portions with the flow "G2*d*", which however are in common with the adjacent actuators: consequentially the flows are superimposed, possibly causing the undesired phenomenon of "cross-talk" (for example, the flow of ink to the central actuator immediately after the ejection of the drop can give rise to imbalances in the ink flow to the actuators adjacent to it, which could reduce the capacity of the said actuators to emit drops in their turn immediately after the central actuator, therefore making it necessary, for example, to delay the ejection in order to ensure its correctness).

This cross-talk may depend both on ink movements and on the presence of air; for example, if the central actuator generates air bubbles because of incorrect operation, then where non-aligned piers 72 are used (FIG. 16) this anomaly would affect areas of the manifold which would also have a negative effect on the operation of the adjacent actuators.

However, if the piers 72 are aligned with the peninsulas 62 (FIG. 14), this anomaly would mainly affect the area of the manifold characterized by the flow "G1*u*", and would therefore be substantially restricted to the central actuator alone, and could easily be rectified or sufficiently reduced before the said actuator was required to eject again.

Figure 8:
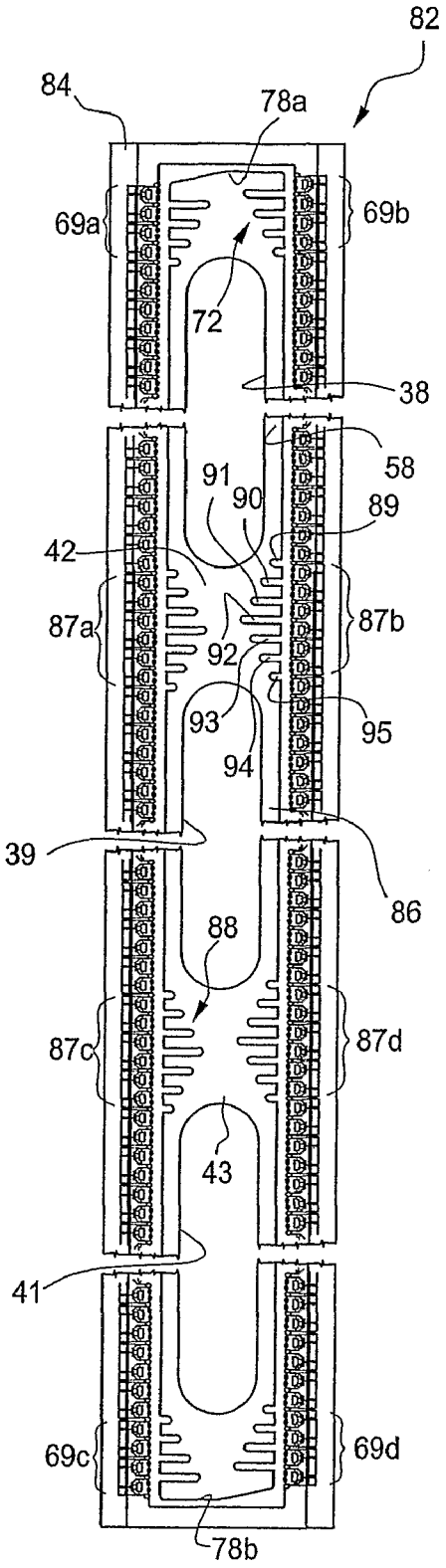
FIG. 8 is a partial plan view of a variant of the print head of FIG. 6.
Figure 9:
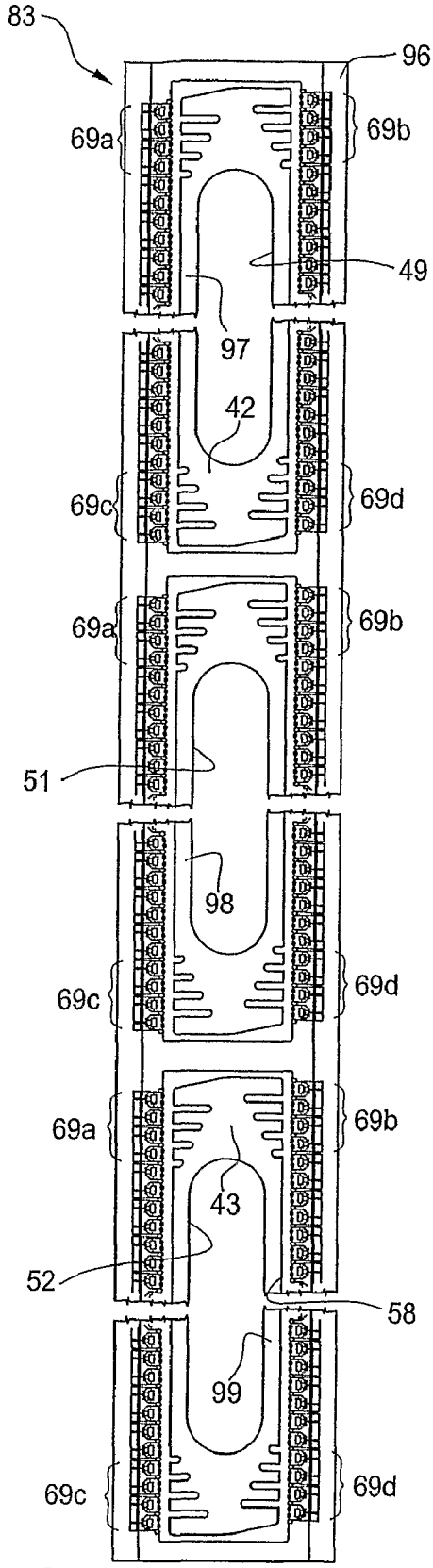
FIG. 9 is a partial plan view of another variant of the print head of FIG. 6.

FIGS. 8 and 9 show two examples of ink jet heads 82 and 83, monochrome and multi-color respectively, having a large number of nozzles (for example 208 nozzles for the monochrome head, and 192 nozzles (64 per color) for the color head) and a correspondingly large longitudinal extension.

In the embodiment of FIG. 9, in particular, there is shown by way of example a three-color head 83, provided with 64 ejection chambers for each color field, positioned in two rows on the opposite sides of the feed slot, with an interval P of 1/300 of an inch; each manifold 97-98-99 has a width of 250 μm (values between 250 and 400 μm are preferred for similar applications) and a length of approximately 3000 μm, extending beyond the ends of the corresponding slot by approximately 400 μm at each end, for feeding the marginal actuators 69*a-b-c-d*. In this embodiment, each slot 49-51-52 has dimensions of 150 μm in width (values between 150 and 360 μm are preferred for similar applications) and approximately 2200 μm in length.

The heads 82 and 83 are similar to the heads 36 and 47 of FIGS. 4 and 5, in which functionally identical parts have the same numbering, but comprise bubble prevention elements according to the invention, associated with the sets of marginal actuators.

The head 82 includes, in particular, a plate 84 with the three partial distribution slots 38, 39, 41, the links of substrate 42 and 43 between the partial slots, and a feed manifold 86. The actuators 33 comprise the two marginal sets 69*a*, 69*b*, 69*c*, 69*d* adjacent to the terminal walls 78*a*, 78*b* of the manifold 86 and two sets of actuators 87*a*, 87*b*, 87*c* and 87*d*, defined as inner marginal actuators, adjacent to the areas of the manifold 86 next to the links 42 and 43 and fed by the slots 38, 39 and 39, 41 respectively.

The bubble prevention elements of the head 82 include the piers 72 associated with the sets of marginal actuators 69*a*, 69*b*, 69*c*, 69*d* and projections 88 associated with the sets of inner marginal actuators 87*a*, 87*b*, 87*c* and 87*d*. The projections 88 are similar to the piers 72 and consist of relatively thin piers 89, 90, 91, 92, 93, 94, 95 aligned with the boundary peninsulas of the actuators. The length of the piers 89, 90, 91, 92, 93, 94, 95 also increases with the distance of the actuators from the slots, the highest value being found in the axis of the links, as shown in FIG. 8.

The head 83 comprises a plate 96 with the three partial distribution slots 51, 52, 53, the substrate links 42 and 43 between the partial slots, and manifolds 97, 98 and 99 associated with the slots 51, 52 and 53. In this case, the actuators 33 comprise three sets of marginal actuators 69*a*, 69*b*, 69*c*, 69*d*, adjacent to the terminal walls 78*a*, 78*b* of the manifolds 97, 98 and 99.

The bubble prevention elements of the head 83 include, for each manifold 97, 98 and 99, the piers 72 associated with the sets of marginal actuators 69*a*, 69*b*, 69*c*, 69*d* and consisting of piers 72, 73, 74, 76 identical to those of the head 66 of FIG. 5. Clearly, this type of protection can also be applied to heads having slots arranged side by side and having less than or more than three slots and/or manifolds.

In the example of embodiment, in the case of the ink jet print head 82, the manifold 86 has a length of 9000-12000 μm and a width of 250-400 μm (similar to that of the head 21). In the case of the color ink jet print head 83, the manifold 97, 98, 99 for the actuators 33 of each color has a length of 3000-4000 μm and a width of 250-400 μm.

The prevention elements according to the invention can advantageously be applied also to heads (not shown) having peninsulas 62 and filter islands 63*a*, 63*b* in different configurations from those described.

By way of example, the ends of the peninsulas can be moved back from the rows of filter islands. Additionally, the function of the islands 63*a* and 63*b* can be carried out by a single, substantially elliptical, filter island, positioned in front of the barrier island 61 and being designed to create a flow of ink limited to the lateral sections "L" and "R".

Figure 11:
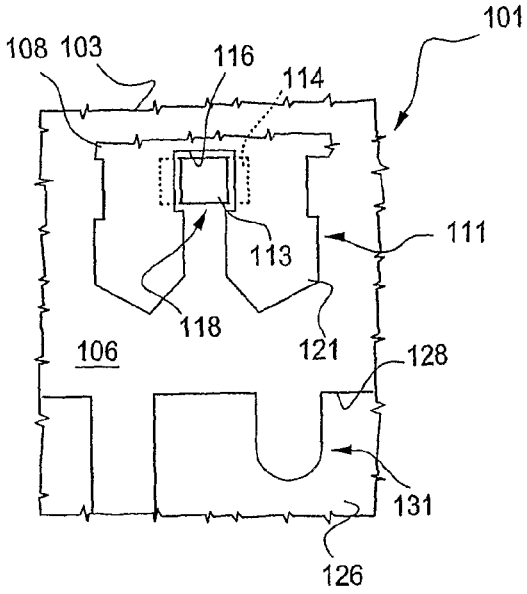
FIG. 11 is a plan diagram of details of a variant of the print head of FIG. 5.
Figure 12:
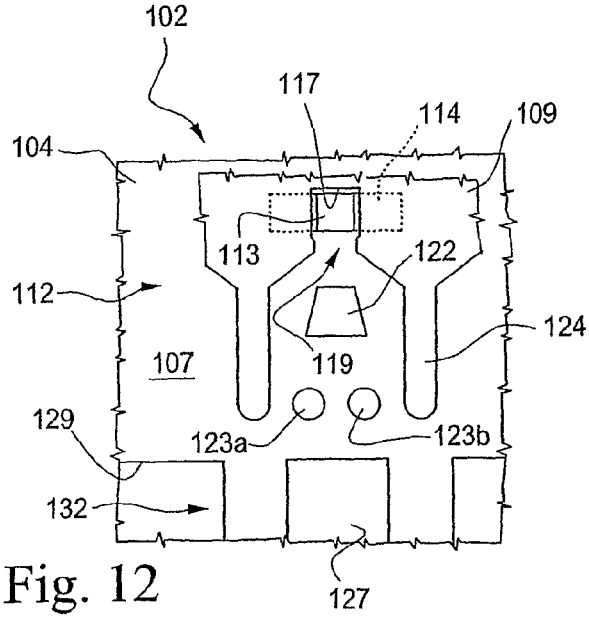
FIG. 12 is a plan diagram of details of another variant of the print head of FIG. 5.

FIGS. 11 and 12 show, respectively, parts of an ink jet print head 101, 102 with an ink distribution slot or slots and a feed manifold or manifolds, similar to the heads 36 and 47 respectively of FIGS. 4 and 5, and including the bubble prevention elements according to the invention.

The head 101, 102 comprises a corresponding substrate plate 103, 104 made from silicon, with an upper surface 106, 107, a structural layer 108, 109 and actuators 111, 112 having sets which are marginal with respect to the slots. Each actuator 111, 112 is functionally identical to the set 33 of FIG. 2 and includes a resistor 113 and conductors 114 deposited on the surface 106, 107, an ejection chamber 116, 117 delimited by three walls of the structural layer 108, 109 and a passage 118 or two passages 119*a* and 119*b* for feeding the ink, also formed in the layer 108, 109.

The head 101 has an ink feed path in which the passage 118 for the chamber 116 is rectilinear and free of barriers, and is delimited by two relatively wide boundary peninsulas 121 which are common to the adjacent feed passages.

The head 102 has an ink feed path in which the passages 119*a* and 119 are separated by a barrier island 122 and in which two filter islands 123*a* and 123*b* are provided. The passages 119*a* and 119*b* are delimited by two relatively narrow boundary peninsulas 124, common to the adjacent feed passages.

In a similar way to the plate 22, 37, each plate 103, 104 has a longitudinal ink distribution slot (not shown) and a feed manifold 126, 127 etched into the upper surface 106, 107 around the slot and delimited by lateral walls 128 and 129. In the manifolds 126, 127 also, the lateral walls are close to the sides of the slot, allowing a direct feed to most of the actuators, and extend beyond the ends of the slot so that the marginal actuators can be adequately fed.

The boundary peninsulas 121 and 124 extend substantially perpendicularly to a longitudinal plane of symmetry of the distribution slot, and their ends are close to the walls 128, 129 of the manifolds 126, 127.

According to the invention, only the marginal actuators of the heads 101, 102 are associated with the bubble prevention elements, formed in the lateral walls 128 and 129 in the form of piers 131, 132. The piers 131, 132 are positioned substantially in line with the boundary peninsulas 121, 124, have different lengths associated with the distance of the chamber 116, 117 from the slot, and do not disturb the ink feed flow towards the said chambers.

The bubble prevent elements according to the invention can consist of relief elements of the base different from the projections of the type described above. By way of example, the prevention piers can be detached and at a short distance from the lateral walls of the manifold.

Figure 13:
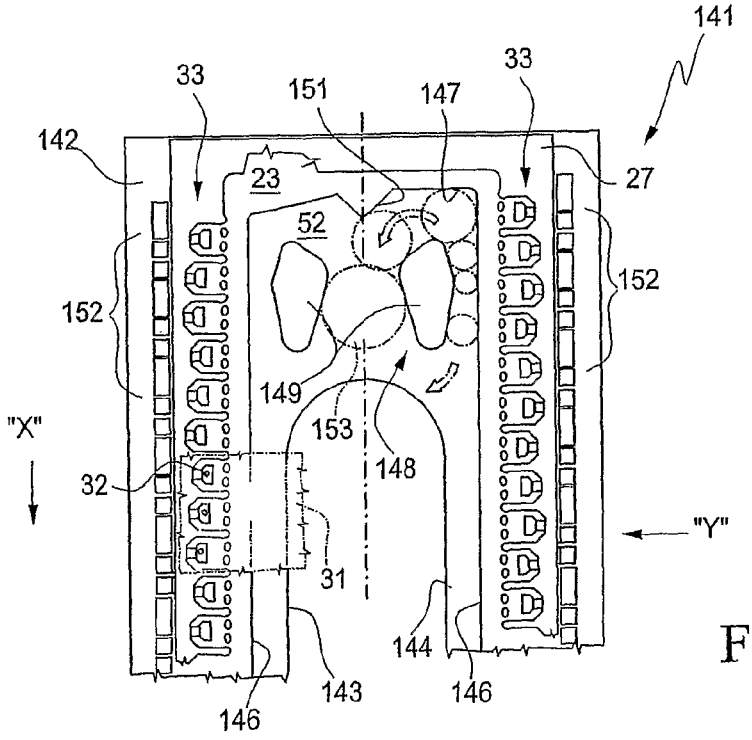
FIG. 13 is a further variant of the print head of FIG. 5.

FIG. 13 shows an alternative embodiment of an ink jet head 141, structurally similar to the head 66 of FIG. 5, in which functionally identical parts have been given the same numbering. The head 141 comprises, in particular, a substrate plate 142 made from silicon, elongated in the longitudinal direction "X", the actuators 33, a distribution slot 143, a manifold 144 delimited by lateral walls 146 and an end wall 147 (only one of which is shown in the figure) and bubble prevention elements 148.

For each end of the slot 143 (only one of which is shown in the figure) the bubble prevention elements 148 include two pairs of islands 149 and an element 151 projecting slightly from the end wall 147. The prevention islands 149 are positioned close to the lateral walls 146 and extend facing a marginal set 152 of 2-3 actuators 33 in each row. The element 151 lies on the axis of the slot and has a substantially triangular cross section and a projection of 20-40 μm.

The islands 149 are shaped with their sides inclined so as to promote the flow of bubbles 153 away from the filter islands 63*a* and 63*b* and from the boundary peninsulas 62 towards the slot 143 or towards the end wall 147. Each pair of islands 149 and the element 151, in turn, guide the bubbles adjacent to the end wall 147 towards the slot 143, as shown in FIG. 13, thus ensuring that, overall, any bubbles are removed in each case from the marginal set of actuators 152.

The configuration of the head 141 also prevents disturbance of the ink flow in the marginal actuators, without requiring an increase in the dimensions of the substrate plate, and can be used, for example, if it is desirable to avoid the configuration of the head 66 for other reasons.

An example of a method for manufacturing the head 66 and the variants 82, 83, 101, 102 and 141 is described in the cited patent application EP 1098771.

Figure 18:
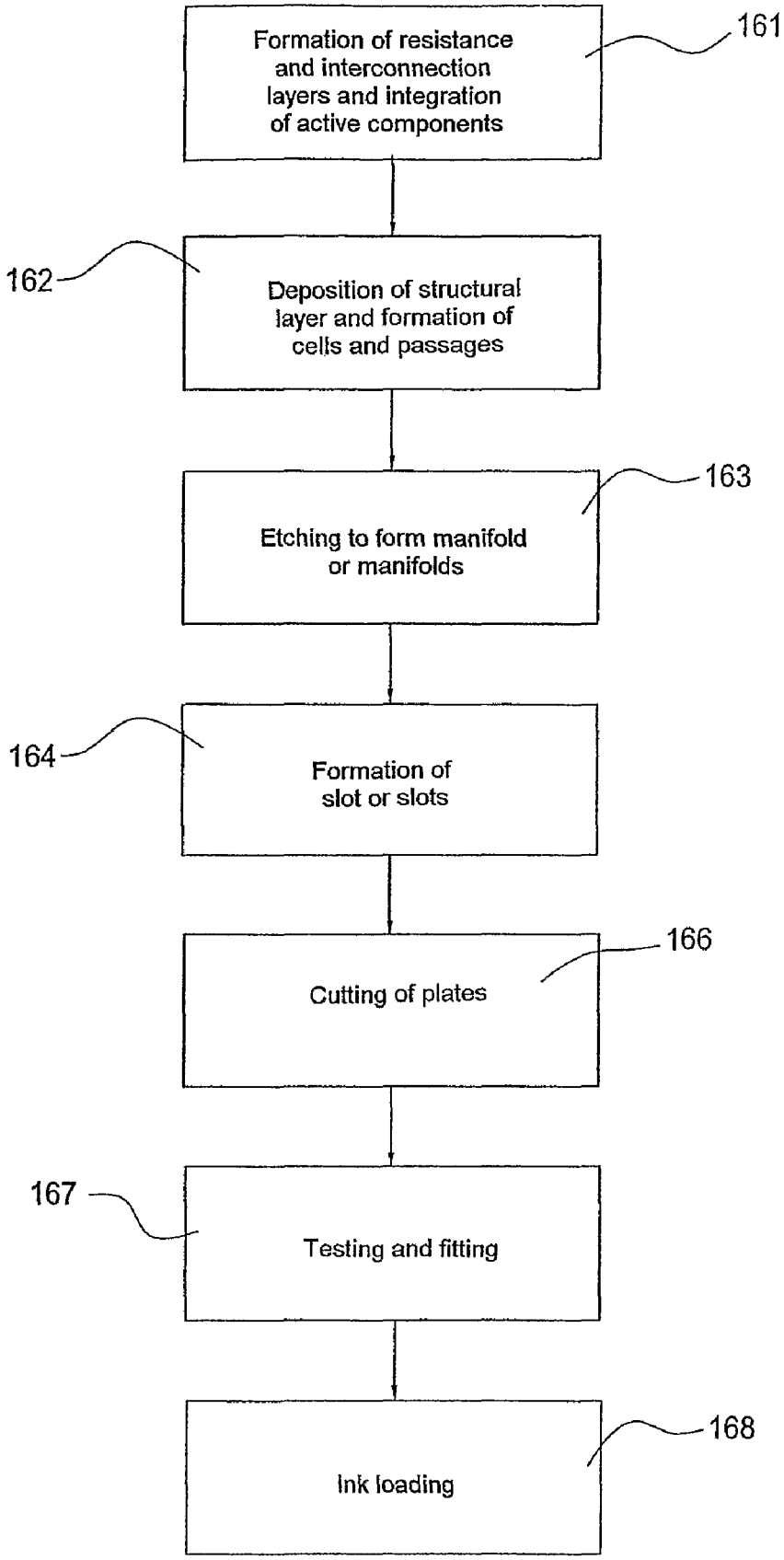
FIG. 18 is a partial block diagram of the method of manufacturing the ink jet head according to the invention.

Very briefly, the manufacturing method comprises, by way of example and with reference to FIG. 18, a step 161 of forming plates 71, 84, 96, 103, 104 in a standard silicon wafer, with the use of known deposition methods to form on the upper face the layers forming the emission resistors and the corresponding electrical interconnections, and also the active electronic components such as the MOS transistors for driving the emission resistors.

This is followed by a deposition step 162 which comprises the deposition on the upper face of the plate of an etching mask, consisting of a layer of photoresist, which leaves free areas of the substrate corresponding to the areas of the manifold 68, 82 or of the manifolds 97, 98, 99 and other variants, and, in marginal areas of the manifold or manifolds, the profiles corresponding to the bubble prevention piers or islands.

The next step is a step of etching 163 which comprises anisotropic etching by dry chemical attack (dry etching) in the areas not protected by the photoresist, at the position of the manifold 68, 82 or the manifolds 97, 98, 99 and of the prevention piers, by a method well known to those skilled in the art.

A slotting step 164 is then carried out, comprising the forming of the slot or slots 34; 38, 39, 41; 49, 51, 52 by a known cutting operation, sandblasting for example, which is conveniently carried out from the lower face of the substrate wafer.

These steps are followed by further ones comprising a cutting step (166) in which the individual plates are separated from the wafer, the joining of the plate to the corresponding orifice plate (if the latter has not been formed as an integral part of it), the connection to the multi-pole power supply and control conductor, the fitting of the head on the tank (167), the loading of the ink (168) and the appropriate tests conducted both during the intermediate steps and at the end of the process. As described above, the prevention projections according to the invention can be formed as part of the head manufacturing process, by appropriate modification of the corresponding masks, without any substantial increase in cost. Furthermore, the transverse dimensions of the plate are not affected by the presence of the bubble prevention piers, so that the advantages of considerable mechanical strength and reduced consumption of silicon are retained.

The machining tolerances in the slotting step are also unchanged. This is because the prevention projections are formed only in the marginal parts of the manifold, whose dimensions are determined by the number of marginal actuation sets specified by the design, independently of considerations of bubble prevention.

The dry etching process forms prevention elements with substantially vertical walls. However, the application of the invention is not dependent on this technology, but is also possible in the case in which the etching is of the wet type, typically producing inclined walls in the manifold and in the prevention elements. There is no change in the mode of operation of elements formed in this way, with appropriate modification of their dimensions.

The formation of the distribution slots by more precise methods than those described, for example by laser or electrochemical etching, can enable smaller tolerances to be achieved in the positions of the walls with respect to the nominal positions. This can yield a further saving of the substrate material for the same strength of the plate.

The invention claimed is:

1. An ink jet print head comprising:

a substrate;

an ink distribution slot passing through a thickness of the substrate;

a manifold formed in a surface of the substrate around said slot, having at least one substantially rectilinear side;

a plurality of actuators positioned in a row substantially parallel to said rectilinear side of said manifold, said row of actuators comprising a first set of actuators adjacent to the slot and a second set of actuators not adjacent to the slot;

a plurality of bubble prevention elements present in said manifold next to said second set of actuators only;

wherein said plurality of bubble prevention elements comprises a plurality of projections formed along said rectilinear side of the manifold and having a length increasing as a function of the distance of said second set of actuators from the ink distribution slot.

2. An ink jet print head according to claim 1, wherein said prevention elements comprise a pair of the prevention elements positioned between one of said actuators and the slot on opposite sides of said actuator.

3. An ink jet print head according to claim 1, in which the actuators have a given interval "P", wherein a space between two prevention elements is a value "D" which is greater than 0.5 P.

4. An ink jet print head according to claim 1, wherein said prevention elements comprise peninsula-like projections of the walls of the aforesaid manifold.

5. An ink jet print head according to claim 1, wherein said peninsula-like projections have a width which is substantially constant.

6. An ink jet print head according to claim 1, wherein each of said actuators comprises an ejection chamber, separated by corresponding boundary peninsulas from the adjacent chambers, and said prevention elements have their longitudinal axes substantially aligned with said boundary peninsulas.

7. An ink jet print head according to claim 1, wherein said prevention elements include islands projecting from a base of the manifold and positioned next to said second set of actuators.

8. An ink jet print head according to claim 1, wherein said substrate includes at least one pair of the slots separated by at least one link and surrounded by a single ink feed manifold and at least one of said prevention elements is positioned next to said link.

* * * * *